US006257499B1

(12) United States Patent
Sturman

(10) Patent No.: US 6,257,499 B1
(45) Date of Patent: Jul. 10, 2001

(54) HIGH SPEED FUEL INJECTOR

(76) Inventor: Oded E. Sturman, 3973 Santa Monica Ct., Newbury Park, CA (US) 91320

( * ) Notice: Subject to any disclaimer, the term of this patent is extended or adjusted under 35 U.S.C. 154(b) by 0 days.

(21) Appl. No.: 09/617,301

(22) Filed: Jul. 17, 2000

Related U.S. Application Data

(63) Continuation of application No. 08/743,858, filed on Nov. 5, 1996, which is a continuation of application No. 08/425,602, filed on Apr. 20, 1995, now abandoned, which is a continuation of application No. 08/254,271, filed on Jun. 6, 1994, now Pat. No. 5,460,329.

(51) Int. Cl.[7] ..... F02M 41/16

(52) U.S. Cl. ..... 239/96; 239/88; 239/90; 251/129.1; 251/30.01

(58) Field of Search ..... 239/88, 90, 92, 239/96; 251/30.01, 129.1

(56) References Cited

U.S. PATENT DOCUMENTS

| | | |
|---|---|---|
| Re. 33,270 | 7/1990 | Beck et al. . |
| 892,191 | 6/1908 | Shuller . |
| 1,700,228 | 1/1929 | Kendall . |
| 2,144,862 | 1/1939 | Truxell, Jr. . |
| 2,421,329 | 5/1947 | Hoffer . |
| 2,434,586 | 1/1948 | Reynolds . |
| 2,512,557 | 6/1950 | Weldy . |
| 2,535,937 | 12/1950 | Le Bozec et al. . |
| 2,552,445 | 5/1951 | Nielsen . |
| 2,597,952 | 5/1952 | Rosenlund . |

(List continued on next page.)

FOREIGN PATENT DOCUMENTS

| | | |
|---|---|---|
| 264710 | of 0000 | (DE) . |
| 40 29 510 A1 | 3/1991 | (DE) . |
| 41 18 236 A1 | 12/1991 | (DE) . |
| 44 01 073 A1 | 1/1994 | (DE) . |
| 195 23 337 A1 | 1/1996 | (DE) . |
| 198 23 337 A1 | 1/1996 | (DE) . |
| 0 0149 598 A2 | 1/1985 | (EP) . |
| 0 184 040 A2 | 6/1986 | (EP) . |
| 0 375 944 A2 | 7/1990 | (EP) . |
| 0 4235 236 A1 | 5/1991 | (EP) . |

(List continued on next page.)

OTHER PUBLICATIONS

Machine Design Tapping A National Resource Feb. 21, 1994, "Breakthrough in Digital Valves" pp. 37–42.
Patent Specification 349,165 "Improved Electro–Magnetic Double–Acting Balanced Valve" dated Mar. 7, 1930.
Complete Specification No. 892121, Improvements in or relating to electro–Magnetically Actuated Piston Slide Valves, Jul. 1, 1958.
SAE Technical Paper Series 930270, "HEUI–A New Direction for Diesel Engine Fuel Systems", S.F. Glassey, A.R. Stockner, and M.A. Flinn, Mar. 1–5, 1993.
SAE Technical Paper Series 930271, Development of the HEUI Fuel System—Integration of Design, Simulation, Test, and Manufacturin, Stockner et al., Mar. 1–5, 1993.

(List continued on next page.)

*Primary Examiner*—David A. Scherbel
*Assistant Examiner*—Steven J. Ganey
(74) *Attorney, Agent, or Firm*—Blakely, Sokoloff, Taylor & Zafman LLP

(57) ABSTRACT

A fuel injector which has a double solenoid three-way or four-way spool valve that controls the flow of a working fluid that is used to move an intensifier piston of the injector.

47 Claims, 4 Drawing Sheets

U.S. PATENT DOCUMENTS

| | | |
|---|---|---|
| 2,621,011 | 12/1952 | Smith . |
| 2,672,827 | 3/1954 | McGowen, Jr. . |
| 2,727,498 | 12/1955 | Reiners . |
| 2,749,181 | 6/1956 | Maxwell et al. . |
| 2,793,077 | 5/1957 | Bovard . |
| 2,912,010 | 11/1959 | Evans et al. . |
| 2,916,048 | 12/1959 | Gunkel . |
| 2,930,404 | 3/1960 | Kowalski et al. . |
| 2,934,090 | 4/1960 | Kenann et al. . |
| 2,946,513 | 7/1960 | Sampietro . |
| 2,967,545 | 1/1961 | Schmidt . |
| 2,985,378 | 5/1961 | Falberg . |
| 3,035,780 | 5/1962 | Peras . |
| 3,057,560 | 10/1962 | Campbell . |
| 3,071,714 | 1/1963 | Hadekel . |
| 3,175,771 | 3/1965 | Breting . |
| 3,368,791 | 2/1968 | Wells . |
| 3,391,871 | 7/1968 | Fleischer et al. . |
| 3,408,007 | 10/1968 | Raichle et al. . |
| 3,410,519 | 11/1968 | Evans . |
| 3,458,769 | 7/1969 | Stampfli . |
| 3,532,121 | 10/1970 | Sturman . |
| 3,570,806 | 3/1971 | Sturman . |
| 3,570,807 | 3/1971 | Sturman . |
| 3,570,833 | 3/1971 | Sturman et al. . |
| 3,575,145 | 4/1971 | Steiger . |
| 3,585,547 | 6/1971 | Sturman . |
| 3,587,547 | 6/1971 | Hussey . |
| 3,604,959 | 9/1971 | Sturman . |
| 3,675,853 | 7/1972 | Lapera . |
| 3,683,239 | 8/1972 | Sturman . |
| 3,689,205 | 9/1972 | Links . |
| 3,718,159 | 2/1973 | Tennis . |
| 3,731,876 | 5/1973 | Showalter . |
| 3,743,898 | 7/1973 | Sturman . |
| 3,753,426 | 8/1973 | Lilley . |
| 3,753,547 | 8/1973 | Topham . |
| 3,796,205 | 3/1974 | Links et al. . |
| 3,814,376 | 6/1974 | Reinicke . |
| 3,821,967 | 7/1974 | Sturman et al. . |
| 3,827,409 | 8/1974 | O'Neill . |
| 3,835,829 | 9/1974 | Links . |
| 3,858,135 | 12/1974 | Gray . |
| 3,868,939 | 3/1975 | Friese et al. . |
| 3,921,604 | 11/1975 | Links . |
| 3,921,901 | 11/1975 | Woodman . |
| 3,943,901 | 3/1976 | Takahashi . |
| 3,989,066 | 11/1976 | Sturman et al. . |
| 3,995,652 | 12/1976 | Belart et al. . |
| 4,046,112 | 9/1977 | Deckard . |
| 4,064,855 | 12/1977 | Johnson . |
| 4,065,096 | 12/1977 | Frantz et al. . |
| 4,069,800 | 1/1978 | Kanda et al. . |
| 4,077,376 | 3/1978 | Thoma . |
| 4,080,942 | 3/1978 | Vincent et al. . |
| 4,083,498 | 4/1978 | Cavanagh et al. . |
| 4,087,736 | 5/1978 | Mori et al. . |
| 4,087,773 | 5/1978 | Jencks et al. . |
| 4,107,546 | 8/1978 | Sturman et al. . |
| 4,108,419 | 8/1978 | Sturman et al. . |
| 4,114,647 | 9/1978 | Sturman et al. . |
| 4,114,658 | 9/1978 | Nakajima et al. . |
| 4,120,456 | 10/1978 | Kimura et al. . |
| 4,152,676 | 5/1979 | Morgenthaler et al. . |
| 4,165,762 | 8/1979 | Acar . |
| 4,182,492 | 1/1980 | Albert et al . |
| 4,189,816 | 2/1980 | Chalansonnet . |
| 4,192,466 | 3/1980 | Tanasawa et al. . |
| 4,217,862 | 8/1980 | Fort et al. . |
| 4,219,154 | 8/1980 | Luscomb . |
| 4,221,192 | 9/1980 | Badgley . |
| 4,231,525 | 11/1980 | Palma . |
| 4,246,876 | 1/1981 | Bouwkamp et al. . |
| 4,248,270 | 2/1981 | Ostrowski . |
| 4,260,333 | 4/1981 | Schillinger . |
| 4,266,727 | 5/1981 | Happel et al. . |
| 4,271,807 | 6/1981 | Links et al. . |
| 4,273,291 | 6/1981 | Müller . |
| 4,275,693 | 6/1981 | Leckie . |
| 4,279,385 | 7/1981 | Straubel et al. . |
| 4,308,891 | 1/1982 | Loup . |
| 4,319,609 | 3/1982 | Debrus . |
| 4,329,951 | 5/1982 | Seilly . |
| 4,342,443 | 8/1982 | Wakeman . |
| 4,346,681 | 8/1982 | Schleicher et al. . |
| 4,354,662 | 10/1982 | Thompson . |
| 4,372,272 | 2/1983 | Walter et al. . |
| 4,375,274 | 3/1983 | Thoma et al. . |
| 4,378,775 | 4/1983 | Straubel et al. . |
| 4,381,750 | 5/1983 | Funada . |
| 4,392,612 | 7/1983 | Deckard et al. . |
| 4,396,037 | 8/1983 | Wilcox . |
| 4,396,151 | 8/1983 | Kato et al. . |
| 4,405,082 | 9/1983 | Walter et al. . |
| 4,409,638 | 10/1983 | Sturman et al. . |
| 4,413,600 | 11/1983 | Yanagawa et al. . |
| 4,414,940 | 11/1983 | Loyd . |
| 4,422,424 | 12/1983 | Luscomb . |
| 4,425,894 | 1/1984 | Kato et al. . |
| 4,437,443 | 3/1984 | Hofbauer . |
| 4,440,132 | 4/1984 | Terada et al. . |
| 4,440,134 | 4/1984 | Nakao et al. . |
| 4,448,169 | 5/1984 | Badgley et al. . |
| 4,449,507 | 5/1984 | Mayer . |
| 4,457,282 | 7/1984 | Muramatsu et al. . |
| 4,459,959 | 7/1984 | Terada et al. . |
| 4,462,368 | 7/1984 | Funada . |
| 4,480,619 | 11/1984 | Igashira et al. . |
| 4,482,094 | 11/1984 | Knape . |
| 4,501,290 | 2/1985 | Sturman et al. . |
| 4,506,833 | 3/1985 | Yoneda et al. . |
| 4,516,600 | 5/1985 | Sturman et al. . |
| 4,518,147 | 5/1985 | Andresen et al. . |
| 4,526,145 | 7/1985 | Honma et al. . |
| 4,526,519 | 7/1985 | Mowbray et al. . |
| 4,527,738 | 7/1985 | Martin . |
| 4,540,126 | 9/1985 | Yoneda et al. . |
| 4,541,387 | 9/1985 | Morikawa . |
| 4,541,390 | 9/1985 | Steinbrenner et al. . |
| 4,541,454 | 9/1985 | Sturman et al. . |
| 4,550,875 | 11/1985 | Teerman et al. . |
| 4,554,896 | 11/1985 | Sougawa . |
| 4,557,685 | 12/1985 | Gellert . |
| 4,558,844 | 12/1985 | Donahue, Jr. . |
| 4,568,021 | 2/1986 | Deckard et al. . |
| 4,572,132 | 2/1986 | Piwonka . |
| 4,599,983 | 7/1986 | Omachi . |
| 4,603,671 | 8/1986 | Yoshinaga et al. . |
| 4,604,675 | 8/1986 | Pflederer . |
| 4,605,166 | 8/1986 | Kelly . |
| 4,610,428 | 9/1986 | Fox . |
| 4,611,632 | 9/1986 | Kolchinsky et al. . |
| 4,619,239 | 10/1986 | Wallenfang et al. . |
| 4,625,918 | 12/1986 | Funada et al. . |
| 4,627,571 | 12/1986 | Kato et al. . |
| 4,628,881 | 12/1986 | Beck et al. . |
| 4,648,580 | 3/1987 | Kuwano et al. . |
| 4,653,455 | 3/1987 | Eblen et al. . |
| 4,658,824 | 4/1987 | Scheibe . |
| 4,669,429 | 6/1987 | Nishida et al. . |
| 4,681,143 | 7/1987 | Sato et al. . |

4,684,067 8/1987 Cotter et al. .
4,699,103 10/1987 Tsukahara et al. .
4,702,212 10/1987 Best et al. .
4,715,541 12/1987 Freudenschuss et al. .
4,719,885 1/1988 Nagano et al. .
4,721,253 1/1988 Noguchi et al. .
4,726,389 2/1988 Minouri et al. .
4,728,074 3/1988 Igashira et al. .
4,741,365 5/1988 Van Ornum .
4,741,478 5/1988 Teerman et al. .
4,753,416 6/1988 Inagaki et al. .
4,770,346 9/1988 Kaczynski .
4,785,787 11/1988 Riszk et al. .
4,787,412 11/1988 Wigmore et al. .
4,794,890 1/1989 Richeson, Jr. .
4,798,186 1/1989 Ganser .
4,807,812 2/1989 Renowden et al. .
4,811,221 3/1989 Sturman et al. .
4,812,884 3/1989 Mohler .
4,813,599 3/1989 Greiner et al. .
4,821,773 4/1989 Herion et al. .
4,825,842 5/1989 Steiger .
4,826,080 5/1989 Ganser .
4,831,989 5/1989 Haines .
4,838,230 6/1989 Matsuoka .
4,838,310 6/1989 Scott et al. .
4,841,936 6/1989 Takahashi .
4,846,440 7/1989 Carlson et al. .
4,869,218 9/1989 FEhlmann et al. .
4,869,429 9/1989 Brooks et al. .
4,870,939 10/1989 Ishikawa et al. .
4,875,499 10/1989 Fox .
4,877,187 10/1989 Daly .
4,884,545 12/1989 Mathis .
4,884,546 12/1989 Sogawa .
4,893,102 1/1990 Bauer .
4,893,652 1/1990 Nogle et al. .
4,905,120 2/1990 Grembowicz et al. .
4,909,440 3/1990 Mitsuyasu et al. .
4,922,878 5/1990 Shinogle et al. .
4,928,887 5/1990 Miettaux .
4,955,334 9/1990 Kawamura .
4,957,084 9/1990 Krämer et al. .
4,957,085 9/1990 Sverdlin .
4,964,571 10/1990 Taue et al. .
4,974,495 12/1990 Richeson, Jr. .
4,979,674 12/1990 Taira et al. .
4,993,637 2/1991 Kanesaka .
5,004,577 4/1991 Ward .
5,016,820 5/1991 Gaskell .
5,036,885 8/1991 Miura .
5,037,031 8/1991 Campbell et al. .
5,042,445 8/1991 Peters et al. .
5,048,488 9/1991 Bronkal .
5,049,971 9/1991 Krumm .
5,050,543 9/1991 Kawamura .
5,050,569 9/1991 Beunk et al. .
5,054,458 10/1991 Wechem et al. .
5,056,488 10/1991 Eckert .
5,067,658 11/1991 De Matthaeis et al. .
5,069,189 12/1991 Saito .
5,076,236 12/1991 Yu et al. .
5,085,193 2/1992 Molrikawa .
5,092,039 3/1992 Gaskell .
5,094,215 3/1992 Gustafson .
5,108,070 4/1992 Tominaga .
5,110,087 5/1992 Studtmann et al. .
5,121,730 6/1992 Ausman et al. .
5,125,807 6/1992 Kohler et al. .
5,131,624 7/1992 Kreuter et al. .
5,133,386 7/1992 Magee .
5,143,291 9/1992 Grinsteiner .
5,156,132 10/1992 Iwanaga .
5,161,779 11/1992 Graner et al. .
5,168,855 12/1992 Stone .
5,176,115 1/1993 Campion .
5,178,359 1/1993 Stobbs et al. .
5,181,494 1/1993 Ausman et al. .
5,188,336 2/1993 Graner et al. .
5,191,867 3/1993 Glassey .
5,207,201 5/1993 Schlagmüller et al. .
5,213,083 5/1993 Glassey .
5,219,122 6/1993 Iwanaga .
5,237,976 8/1993 Lawrence et al. .
5,244,002 9/1993 Frederick .
5,245,970 9/1993 Iwaszkiewicz et al. .
5,249,603 10/1993 Byers, Jr. .
5,251,659 10/1993 Sturman et al. .
5,251,671 10/1993 Hiroki .
5,261,366 11/1993 Regueiro .
5,261,374 11/1993 Gronenberg et al. .
5,269,269 12/1993 Kreuter .
5,271,371 12/1993 Meints et al. .
5,287,829 2/1994 Rose .
5,287,838 2/1994 Wells .
5,293,551 3/1994 Perkins et al. .
5,297,523 3/1994 Hafner et al. .
5,313,924 5/1994 Regueiro .
5,325,834 7/1994 Ballheimer et al. .
5,339,777 8/1994 Cannon .
5,345,916 9/1994 Amann et al. .
5,346,673 9/1994 Althausen et al. .
5,357,912 10/1994 Barnes et al. .
5,375,576 12/1994 Ausman et al. .
5,410,994 5/1995 Schecter .
5,423,302 6/1995 Glassey .
5,423,484 6/1995 Zuo .
5,429,309 7/1995 Stockner .
5,445,129 8/1995 Barnes .
5,447,138 9/1995 Barnes .
5,460,329 10/1995 Sturman .
5,463,996 11/1995 Maley et al. .
5,477,828 12/1995 Barnes .
5,478,045 12/1995 Ausman et al. .
5,479,901 1/1996 Gibson et al. .
5,485,957 1/1996 Sturman .
5,487,368 1/1996 Bruning .
5,487,508 1/1996 Zuo .
5,492,098 2/1996 Hafner et al. .
5,492,099 2/1996 Maddock .
5,499,608 3/1996 Meister et al. .
5,499,609 3/1996 Evans et al. .
5,499,612 3/1996 Haughney et al. .
5,505,384 4/1996 Camplin .
5,509,391 4/1996 DeGroot .
5,515,829 5/1996 Wear et al. .
5,522,545 6/1996 Camplin et al. .
5,529,044 6/1996 Barnes et al. .
5,535,723 7/1996 Gibson et al. .
5,577,892 11/1996 Schittler et al. .
5,597,118 1/1997 Carter, Jr. et al. .
5,598,871 2/1997 Sturman et al. .
5,622,152 4/1997 Ishida .
5,632,444 5/1997 Camplin et al. .
5,638,781 6/1997 Sturman .
5,640,987 6/1997 Sturman .
5,641,148 6/1997 Pena et al. .
5,669,334 9/1997 Schonfeld et al. .
5,669,355 9/1997 Gibson et al. .
5,682,858 11/1997 Chen et al. .
5,697,342 12/1997 Anderson et al. .
5,720,318 2/1998 Nagarajan et al. .

| | | |
|---|---|---|
| 5,823,429 | 10/1998 | Beck et al. . |
| 5,871,155 | 2/1999 | Stockner et al. . |
| 5,878,958 | 3/1999 | Lambert . |
| 6,026,785 | 2/2000 | Zuo . |

FOREIGN PATENT DOCUMENTS

| | | |
|---|---|---|
| 0 246 373 B1 | 3/1992 | (EP) . |
| 349 165 | 5/1931 | (GB) . |
| 0892 121 | 3/1962 | (GB) . |
| 2 308 175 | 9/1998 | (GB) . |
| 4-341653 | of 1992 | (JP) . |
| 2 209 206 | of 0000 | (RU) . |
| WO 95/27865 | 10/1995 | (WO) . |
| WO 96/04477 | 2/1996 | (WO) . |
| WO 96/07820 | 3/1996 | (WO) . |
| WO 96/08656 | 3/1996 | (WO) . |
| WO 96/17167 | 6/1996 | (WO) . |
| WO 97/02423 | 1/1997 | (WO) . |

OTHER PUBLICATIONS

SAE Technical Paper Series 940586, Benefits of New Fuel Injection System Technology on Cold . . . (ECD–U2), Osuka et al., Feb. 28–Mar. 3, 1994.

"Electronic Unit Injectors–Revised", Frankl et al.; pp. 1–9.

Brezonick, North American Edition, Diesel Progress, Aug. 1997, Vickers Taking Closer Aim at Mobile Markets, by.

Brown, "The Swing to Cleaner, Smarter Hydraulics", Industrial Management & Technology, Fortune 152[A], Jan. 1997 by.

Sturman Industries Gets Innovative All the Way!, The Bugle, Apr. 1993, vol. 19, Issue 4.

SuperFlow News, vol. 13, Spring 1998, "Sturman Tests Revolutionary Fuel Injectors".

Wilson, North American Edition, Diesel Progress, Apr. 1997, Developments in Digital Valve Technology.

Nowatzyk, G., Communications Architecture for Multiprocessor Networks, Ph.D. dissertation, Carnegie Mellon University, 1989, (see chapter 3).

Roters, "Electromagnetic Devices," First Edition, pp. 44–45, 67, 70.

Patent Specification No. 1 465 283, Improvements in Fuel Injectors for Internal Combustion Engines, Seiji Suda et al., published Feb. 23, 1977.

HIGH SPEED FUEL INJECTOR

This application is a continuation of application Ser. No. 08/743,858, filed Nov. 5, 1996, which is a continuation of application Ser. No. 08/425,602, filed on Apr. 20, 1995, abandoned, which is a continuation of application Ser. No. 08/254,271, filed Jun. 6, 1994, U.S. Pat. No. 5,460,329, issued on Oct. 24, 1995.

BACKGROUND OF THE INVENTION

1. Field of the Invention

The present invention relates to a fuel injector for an internal combustion engine.

2. Description of Related Art

Fuel injectors are used to introduce pressurized fuel into the combustion chamber of an internal combustion engine. FIG. 1 shows a fuel injection system 10 of the prior art. The injection system includes a nozzle 12 that is coupled to a fuel port 14 through an intensifier chamber 16. The intensifier chamber 16 contains an intensifier piston 18 which reduces the volume of the chamber 16 and increases the pressure of the fuel therein. The pressurized fuel is released into a combustion chamber through the nozzle 12.

The intensifier piston 18 is stroked by a working fluid that is controlled by a poppet valve 20. The working fluid enters the valve through port 22. The poppet valve 20 is coupled to a solenoid 24 which can be energized to pull the valve into an open position. As shown in FIG. 2, when the solenoid 24 opens the poppet valve 20, the working fluid applies a pressure to the intensifier piston 18. The pressure of the working fluid moves the piston 18 and pressurizes the fuel. When the solenoid 24 is deenergized, springs 26 and 28 return the poppet valve 20 and the Intensifier piston 18 back to the original positions.

Spring return fuel injectors are relatively slow because of the slow response time of the poppet valve return spring. Additionally, the spring rate of the spring generates an additional force which must be overcome by the solenoid. Consequently the solenoid must be provided with enough current to overcome the spring force and the inertia of the valve. Higher currents generate additional heat and degrade the life and performance of the solenoid. Furthermore, the spring rate of the springs may change because of creep and fatigue. The change in spring rate will create varying results over the life of the injector.

Conventional fuel injectors typically incorporate a mechanical feature which determines the shape of the fuel curve. Mechanical rate shapers are relatively inaccurate and are susceptible to wear and fatigue. Additionally, fuel leakage into the spring chambers of the nozzle and the intensifier may create a hydrostatic pressure that will degrade the performance of the valve.

The graph of FIG. 3 shows an ideal fuel injection rate for a fuel injector. To improve the efficiency of the engine, it is desirable to pre-inject fuel into the combustion chamber before the main discharge of fuel. As shown in phantom, the fuel curve should ideally be square so that the combustion chamber receives an optimal amount of fuel. Actual fuel injection curves have been found to be less than ideal, thereby contributing to the inefficiency of the engine. It is desirable to provide a high speed fuel injector that will supply a more optimum fuel curve than fuel injectors in the prior art.

As shown in FIGS. 1 and 2, the poppet valve constantly strikes the valve seat during the fuel injection cycles of the injector. Eventually the seat and the poppet valve will wear, so that the valve is not properly seated within the valve chamber. Improper valve seating may result in an early release of the working fluid into the intensifier chamber, causing the injector to prematurely inject fuel into the combustion chamber. It would be desirable to provide an injector valve that did not create wear between the working fluid control valve and the associated valve seat of the injector.

SUMMARY OP THE INVENTION

The present invention is a fuel injector which has a double solenoid three-way or four-way spool valve that controls the flow of a working fluid that is used to move an intensifier piston of the injector. The fuel injector includes a nozzle which is in fluid communication with a fuel port through a pressure chamber. The pressure chamber contains an intensifier piston which can move to decrease the volume of the chamber and increase the pressure of the fuel. The pressurized fuel is discharged into the combustion chamber of an engine through the nozzle of the injector.

The spool valve is moved by a pair of solenoids between a first position and a second position. Movement of the spool valve provides fluid communication between the intensifier piston and the working fluid ports of the injector, so that the working fluid strokes the intensifier piston. It has been found that the solenoid control valve of the present invention is very responsive and provides a more optimal fuel curve than injectors in the prior art. Additionally, the spool valve moves between bearing surfaces of a valve housing that are separate from the valve seats of the working fluid ports, thereby reducing wear on the seats and insuring a repeatable operation of the control valve.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 4:
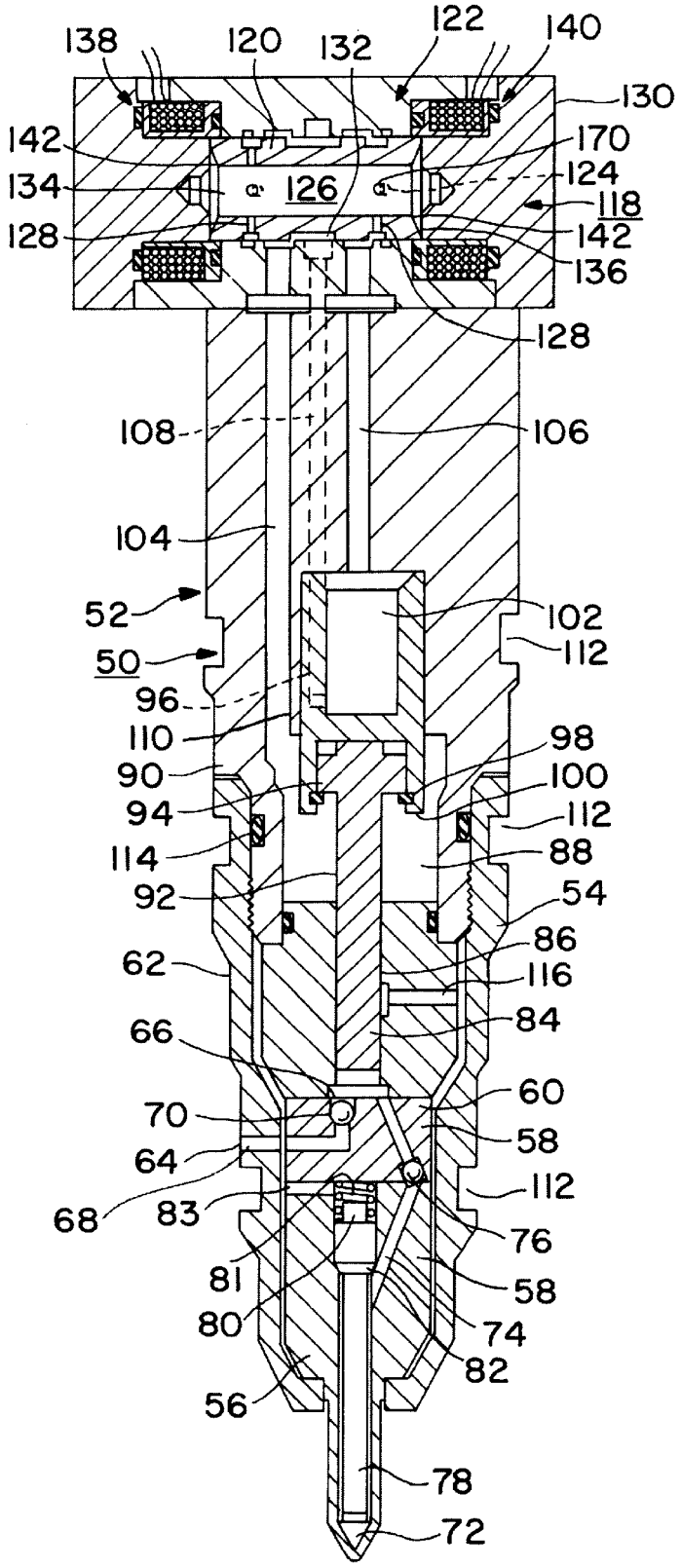
FIG. 4 is a cross-sectional view of a fuel injector with a four-way control valve that has a spool valve in a first position.
Figure 5:
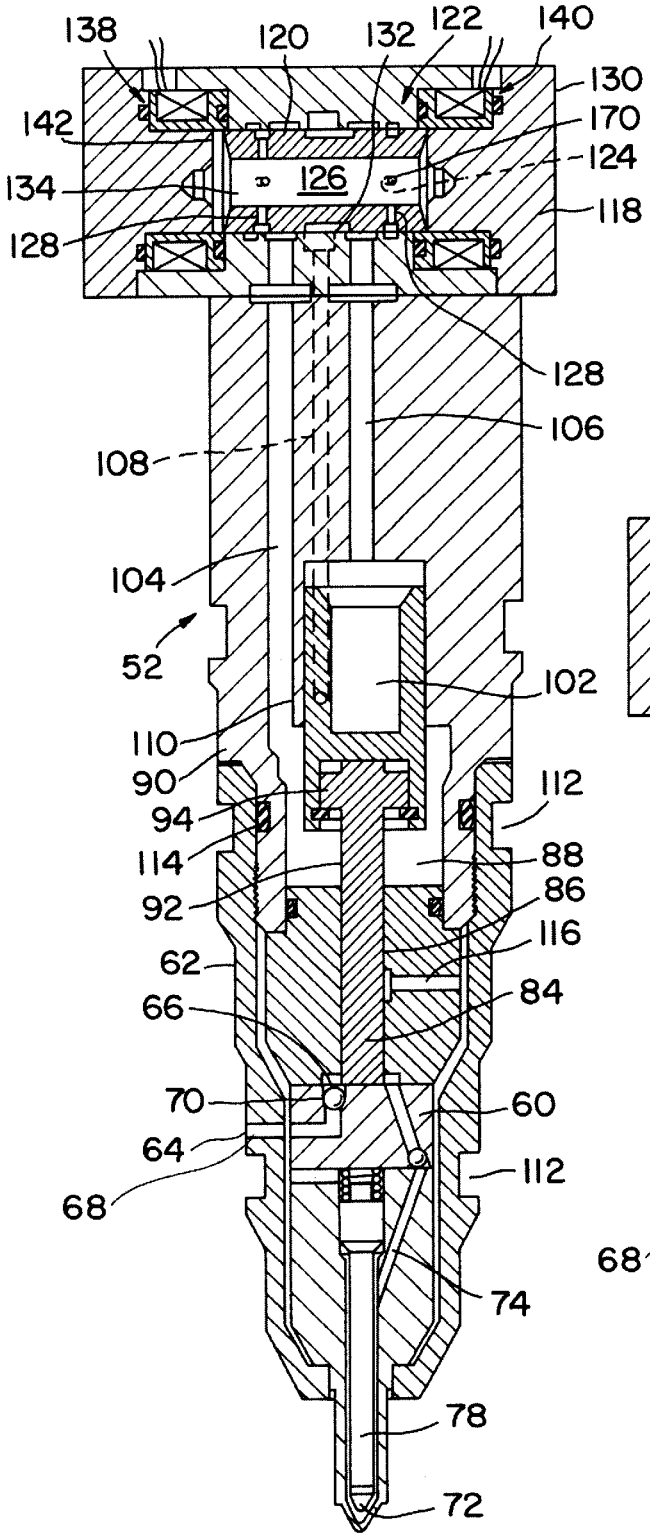
FIG. 5 is a cross-sectional view of the fuel injector with the spool valve in a second position.

Referring to the drawings more particularly by reference numbers, FIGS. 4 and 5 show a fuel injector 50 of the present invention. The fuel injector 50 is typically mounted to an engine block and injects a controlled pressurized volume of fuel into a combustion chamber (not shown). The injector 50 of the present invention is typically used to inject diesel fuel into a compression ignition engine, although it is to be understood that the injector could also be used in a spark ignition engine or any other system that requires the injection of a fluid.

The fuel injector 10 has an injector housing 52 that is typically constructed from a plurality of individual parts. The housing 52 includes an outer casing 54 that contains block members 56, 58, and 60. The outer casing 54 has a fuel port 64 that is coupled to a fuel pressure chamber 66 by a fuel passage 68. A first check valve 70 is located within fuel passage 68 to prevent a reverse flow of fuel from the pressure chamber 66 to the fuel port 64. The pressure chamber 66 is coupled to a nozzle 72 through fuel passage 74.

A second check valve 76 is located within the fuel passage 74 to prevent a reverse flow of fuel from the nozzle 72 to the pressure chamber 66.

The flow of fuel through the nozzle 72 is controlled by a needle valve 78 that is biased into a closed position by spring 80 located within a spring chamber 81. The needle valve 78 has a shoulder 82 above the location where the passage 74 enters the nozzle 78. When fuel flows into the 30 passage 74 the pressure of the fuel applies a force on the shoulder 82. The shoulder force lifts the needle valve 78 away from the nozzle openings 72 and allows fuel to be discharged from the injector 50.

A passage 83 may be provided between the spring chamber 81 and the fuel passage 68 to drain any fuel that leaks into the chamber 81. The drain passage 83 prevents the build up of a hydrostatic pressure within the chamber 81 which could create a counteractive force on the needle valve 78 and degrade the performance of the injector 10.

The volume of the pressure chamber 66 is varied by an intensifier piston 84. The intensifier piston 84 extends through a bore 86 of block 60 and into a first intensifier chamber 88 located within an upper valve block 90. The piston 84 includes a shaft member 92 which has a shoulder 94 that is attached to a head member 96. The shoulder 94 is retained in position by clamp 98 that fits within a corresponding groove 100 in the head member 96. The head member 96 has a cavity which defines a second intensifier chamber 102.

The first intensifier chamber 88 is in fluid communication with a first intensifier passage 104 that extends through block 90. Likewise, the second intensifier chamber 102 is in fluid communication with a second intensifier passage 106.

The block 90 also has a supply working passage 108 that is in fluid communication with a supply working port 110. The supply port is typically coupled to a system that supplies a working fluid which is used to control the movement of the intensifier piston 84. The working fluid is typically hydraulic fluid that circulates in a closed system separate from the fuel. Alternatively the fuel could also be used as the working fluid. Both the outer body 54 and block 90 have a number of outer grooves 112 which typically retain O-rings (not shown) that seal the injector 10 against the engine block. Additionally, block 62 and outer shell 54 may be sealed to block 90 by O-ring 114.

Block 60 has a passage 116 that is in fluid communication with the fuel port 64. The passage 116 allows any fuel that leaks from the pressure chamber 66 between the block 62 and piston 84 to be drained back into the fuel port 64. The passage 116 prevents fuel from leaking into the first intensifier chamber 88.

The flow of working fluid into the intensifier chambers 88 and 102 can be controlled by a four-way solenoid control valve 118. The control valve 118 has a spool 120 that moves within a valve housing 122. The valve housing 122 has openings connected to the passages 104, 106 and 108 and a drain port 124. The spool 120 has an inner chamber 126 and a pair of spool ports that can be coupled to the drain ports 124. The spool 120 also has an outer groove 132. The ends of the spool 120 have openings 134 which provide fluid communication between the inner chamber 126 and the valve chamber 134 of the housing 122. The openings 134 maintain the hydrostatic balance of the spool 120.

The valve spool 120 is moved between the first position shown in FIG. 4 and a second position shown in FIG. 5, by a first solenoid 138 and a second solenoid 140. The solenoids 138 and 140 are typically coupled to a controller which controls the operation of the injector. When the first solenoid 138 is energized, the spool 120 is pulled to the first position, wherein the first groove 132 allows the working fluid to flow from the supply working passage 108 into the first intensifier chamber 88, and the fluid flows from the second intensifier chamber 102 into the inner chamber 126 and out the drain port 124. When the second solenoid 140 is energized the spool 120 is pulled to the second position, wherein the first groove 132 provides fluid communication between the supply working passage 108 and the second intensifier chamber 102, and between the first intensifier chamber 88 and the drain port 124.

The groove 132 and passages 128 are preferably constructed so that the initial port is closed before the final port is opened. For example, when the spool 120 moves from the first position to the second position, the portion of the spool adjacent to the groove 132 initially blocks the first passage 104 before the passage 128 provides fluid communication between the first passage 104 and the drain port 124. Delaying the exposure of the ports, reduces the pressure surges in the system and provides an injector which has more predictable firing points on the fuel injection curve.

The spool 120 typically engages a pair of bearing surfaces 142 in the valve housing 122. Both the spool 120 and the housing 122 are preferably constructed from a magnetic material such as a hardened 52100 or 440c steel, so that the hystersis of the material will maintain the spool 120 in either the first or second position. The hystersis allows the solenoids to be de-energized after the spool 120 is pulled into position. In this respect the control valve operates in a digital manner, wherein the spool 120 is moved by a defined pulse that is provided to the appropriate solenoid. Operating the valve in a digital manner reduces the heat generated by the coils and increases the reliability and life of the injector.

In operation, the first solenoid 138 is energized and pulls the spool 120 to the first position, so that the working fluid flows from the supply port 110 into the first intensifier chamber 88 and from the second intensifier chamber 102 into the drain port 124. The flow of working fluid into the intensifer chamber 88 moves the piston 84 and increases the volume of chamber 66. The increase in the chamber 66 volume decreases the chamber pressure an draws fuel into the chamber $6_6$ from the fuel port 64. Power to the first solenoid 138 is terminated when the spool 120 reaches the first position.

When the chamber 66 is filled with fuel, the second solenoid 140 is energized to pull the spool 120 into the second position. Power to the second solenoid 140 is terminated when the spool reaches the second position. The movement of the spool 120 allows working fluid to flow into the second intensifier chamber 102 from the supply port 110 and from the first intensifier chamber 88 into the drain port 124.

The head 96 of the intensifier piston 96 has an area much larger than the end of the piston 84, so that the pressure of the working fluid generates a force that pushes the intensifier piston 84 and reduces the volume of the pressure chamber 66. The stroking cycle of the intensifier piston 84 increases the pressure of the fuel within the pressure chamber 66. The pressurized fuel is discharged from the injector through the nozzle 72. The fuel is typically introduced to the injector at a pressure between 1000–2000 psi. In the preferred embodiment, the piston has a head to end ratio of approximately 10:1, wherein the pressure of the fuel discharged by the injector is between 10,000–20,000 psi.

Figure 1:
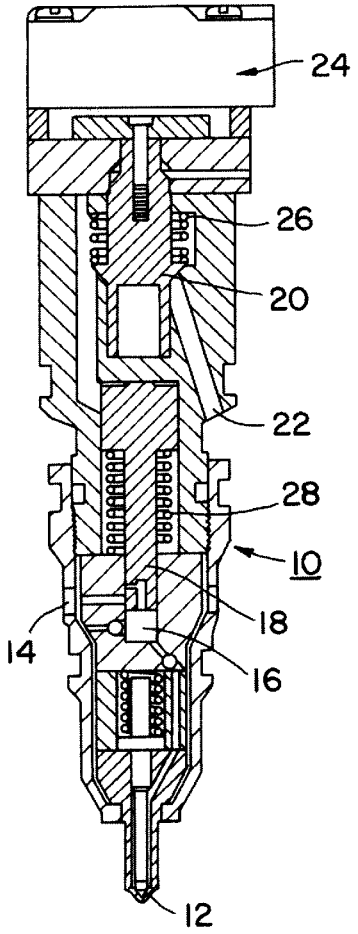
FIG. 1 PRIOR ART
FIG. 1 is a cross-sectional view of a fuel injector of the prior art.
Figure 2:
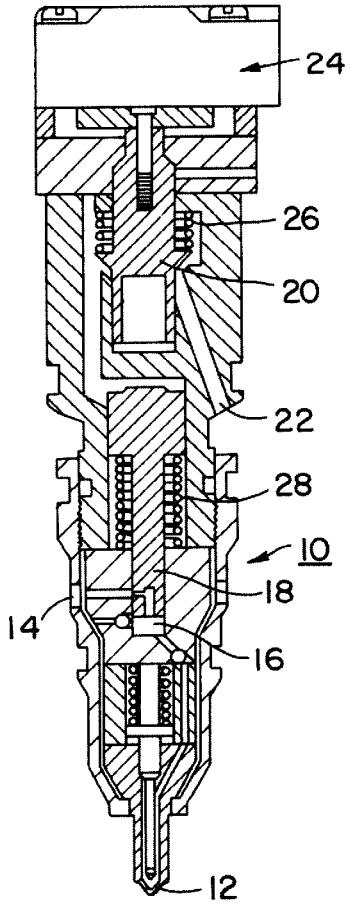
FIG. 2 PRIOR ART
FIG. 2 is a cross-sectional view similar to FIG. 1, showing the fuel injector injecting fuel.
Figure 3:
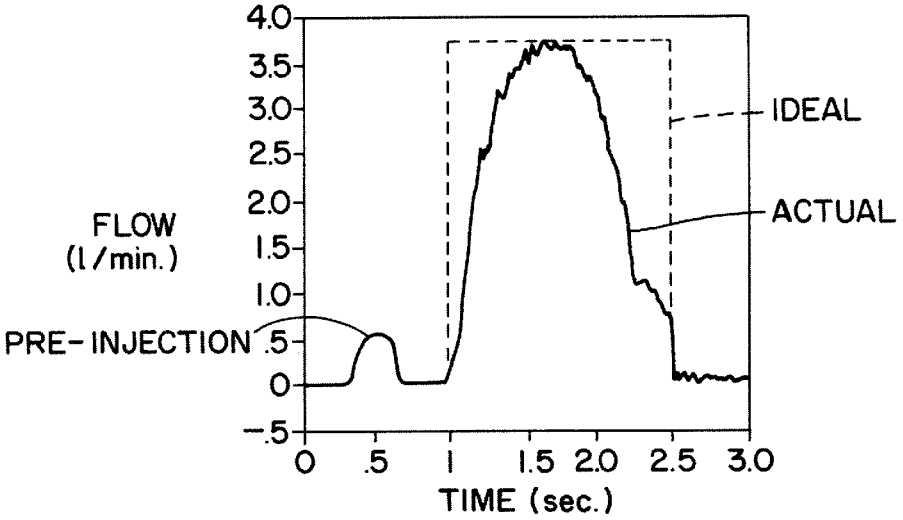
FIG. 3 is a graph showing the ideal and actual fuel injection curves for a fuel injector.

After the fuel is discharged from the injector the first solenoid 138 is again energized to pull the spool 120 to the first position and the cycle is repeated. It has been found that the double solenoid spool valve of the present invention provide a fuel injector which can more precisely discharge fuel into the combustion chamber of the engine than injectors of the prior art. The increase in accuracy provides a fuel injector that more closely approximates the square fuel curve shown in the graph of FIG. 3. The high speed solenoid control valves can also accurately supply the pre-discharge of fuel shown in the graph.

Figure 6:
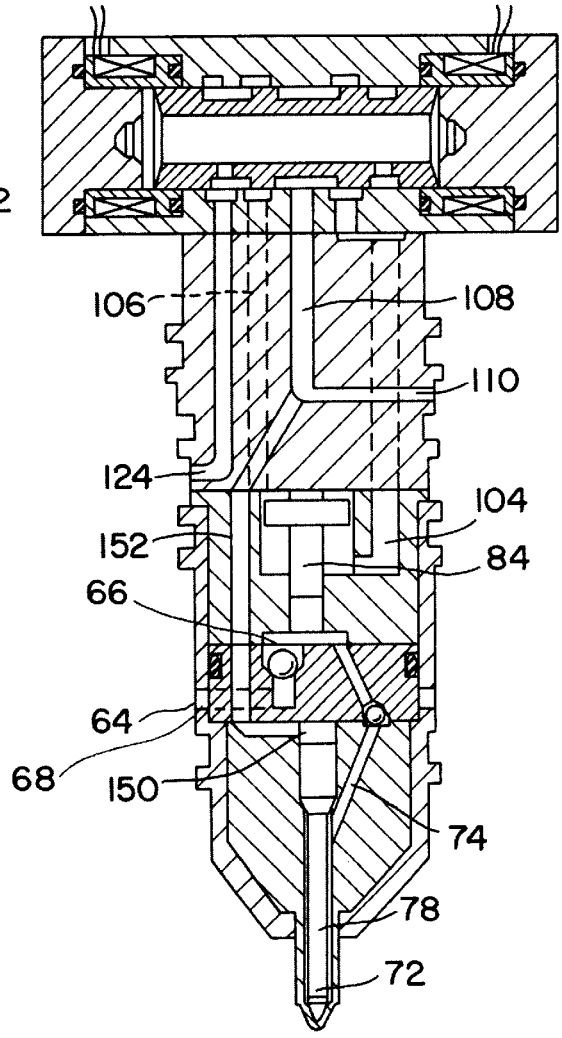
FIG. 6 is an alternate embodiment of the fuel injector of FIG. 4.

FIG. 6 shows an alternate embodiment of a fuel injector of the present invention which does not have a return spring for the needle valve. In this embodiment the supply working passage 108 is coupled to a nozzle return chamber 150 by passage 152. The needle valve 78 is biased into the closed position by the pressure of the working fluid in the return chamber 150. When the intensifier piston 84 is stroked, the pressure of the fuel is much greater than the pressure of the working fluid, so that the fuel pressure pushes the needle valve 78 away from the nozzle openings 72. When the intensifier piston 84 returns to the original position, the pressure of the working fluid within the return chamber 150 moves the needle valve 78 and closes the nozzle 72.

Figure 7:
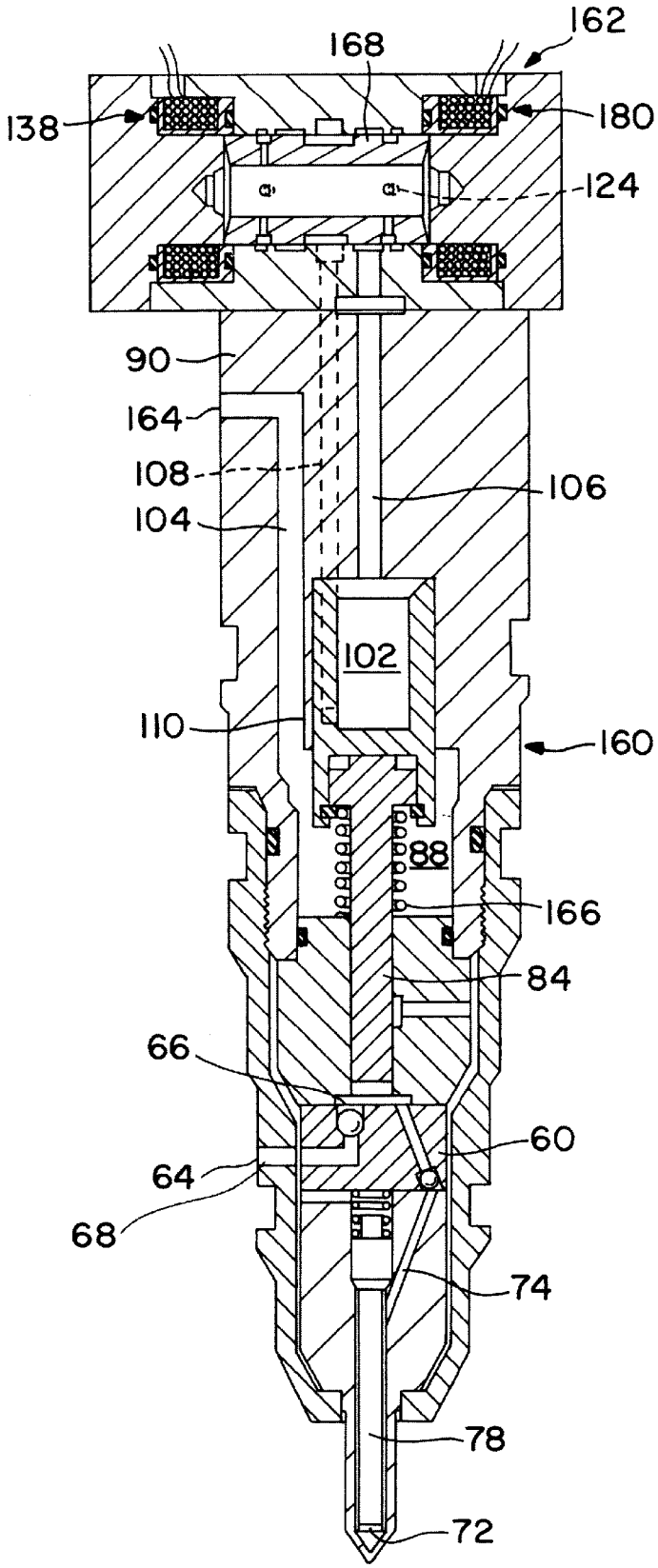
FIG. 7 is a cross-sectional view of an alternate embodiment of a fuel injector which has a three-way control valve.

FIG. 7 shows an injector 160 controlled by a three-way control valve 162. In this embodiment, the first passage 108 is connected to a drain port 164 in block 90, and the intensifier piston 84 has a return spring 166 which biases the piston 84 away from the needle valve 78. Movement of the spool 168 provides fluid communication between the second passage 106 and either the supply port 110 or the drain port 124.

When the spool 168 is in the second position, the second passage 106 is in fluid communication with the supply passage 108, wherein the pressure within the second intensifier chamber 102 pushes the intensifier piston 84 and pressurized fuel is ejected from the injector 160. The fluid within the first intensifier chamber 88 flows through the drain port 164 and the spring 166 is deflected to a compressed state. When the spool 168 is pulled by the first solenoid 138 back to the first position, the second passage 106 is in fluid communication with the drain port 124 and the second intensifier chamber 102 no longer receives pressurized working fluid from the supply port 110. The force of the spring 166 moves the intensifier piston 84 back to the original position. The fluid within the second intensifier chamber 102 flows through the drain port 124.

Both the three-way and four-way control valves have inner chambers 126 that are in fluid communication with the valve chamber 132 through spool openings 134, and the drain ports 124 through ports 130. The ports inner chamber and openings insure that any fluid pressure within the valve chamber is applied equally to both ends of the spool. The equal fluid pressure balances the spool so that the solenoids do not have to overcome the fluid pressure within the valve chamber when moving between positions. Hydrostatic pressure will counteract the pull of the solenoids, thereby requiring more current for the solenoids to switch the valve. The solenoids of the present control valve thus have lower power requirements and generate less heat than injectors of the prior art, which must supply additional power to overcome any hydrostatic pressure within the valve. The balanced spool also provides a control valve that has a faster response time, thereby increasing the duration interval of the maximum amount of fuel emitted by the injector. Increasing the maximum fuel duration time provides a fuel injection curve that is more square and more approximates an ideal curve.

As shown in FIG. 4, the ends of the spool 120 may have concave surfaces 170 that extend from an outer rim to openings 134 in the spool 120. The concave surfaces 170 function as a reservoir that collects any working fluid that leaks into the gaps between the valve housing 122 and the end of the spool. The concave surfaces significantly reduce any hydrostatic pressure that may build up at the ends of the spool 120. The annular rim at the ends of the spool 120 should have an area sufficient to provide enough hysteris between the spool and housing to maintain the spool in position after the solenoid has been de-energized.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fuel injector, comprising:

a housing that has a fuel port for receiving a fuel, a pressure chamber in fluid communication with said fuel port, a supply working port and a return working port for receiving and releasing a working fluid, said housing further having a supply working passage in fluid communication with said supply working port, a return working passage in fluid communication with said return working port, a first intensifier passage in fluid communication with a first intensifier chamber and a second intensifier passage in fluid communication with a second intensifier chamber;

a nozzle that discharges the fuel from said housing;

an intensifier that moves between a return position and a power position, wherein said intensifier delivers the fuel from the pressure chamber to the nozzle when the intensifier moves from the return position to the power position, said intensifier being adjacent to said pressure chamber, said first intensifier chamber, and said second intensifier chamber;

a needle valve that controls the discharge of the fuel from said housing by said nozzle, said nozzle discharging the fuel from said housing as the intensifier moves from the return position to the power position;

a valve housing;

a spool that is located within said valve housing and moves between a first position and a second position, said spool having a first groove that provides fluid communication between said supply working passage and said first intensifier passage when said spool valve is in said first position and fluid communication between said supply working passage and said second intensifier passage when said spool is in said second position, said spool also having a pair of passages and an internal chamber that provide fluid communication between said second intensifier passage and said return working passage when said spool is in said first position, and fluid communication between said first intensifier passage and said return working passage when said spool is in said second position, wherein said first intensifier chamber is pressurized and said intensifier moves to the return position when said spool is in the first position and said second intensifier chamber is pressurized and said intensifier moves to the power position when said spool is in the second position;

a first solenoid operatively connected to said spool to move said spool from said second position to said first position; and, a second solenoid operatively connected to said spool to move said spool from said first position to said second position.

2. The fuel injector as recited in claim 1, wherein said valve housing has a pair of bearing surfaces, said spool being cylindrical in shape with a pair opposite ends that engage said bearing surface and an outer longitudinal wall between said ends which contain the groove and the passages.

3. The fuel injector as recited in claim 1, wherein said spool moves within a valve chamber of said valve housing, said spool having a pair of opening that provide fluid communication between said inner chamber and said valve chamber.

4. The fuel injector as recited in claim 1, wherein said housing has a passage that provides fluid communication between said fuel port and a spring chamber which houses a spring that urges said needle valve toward said nozzle.

5. The fuel injector as recited in claim 1, wherein said housing has a passage that provides fluid communication between said supply working passage and a nozzle return chamber.

6. The fuel injector as recited in claim 1, Wherein said valve housing and said spool are constructed from a magnetic material with enough residual magnetism to maintain said spool position when said solenoids are de-energized and allows said spool end to be separated from said valve housing when said solenoid is energized.

7. The fuel injector as recited in claim 1, wherein the working fluid is also the fuel.

8. The fuel injector as recited in claim 1, wherein said housing has a passage that provides fluid communication between said supply working passage and a nozzle return chamber to supply said working fluid to urge said needle valve toward said nozzle.

9. The fuel injector as recited in claim 1, wherein delivery of the fuel from the pressure chamber to the nozzle lifts said needle valve away from said nozzle as the intensifier moves from the return position to the power position.

10. A fuel injector, comprising:

a housing that has a fuel port for receiving a fuel, a pressure chamber in fluid communication with said fuel port, a supply working port and a return working port for receiving and releasing a working fluid, said housing further having a supply working passage in fluid communication with said supply working port, a return working passage in fluid communication with said return working port, a first intensifier passage in fluid communication with a first intensifier chamber and a second intensifier passage in fluid communication with a second intensifier chamber;

a nozzle that discharges the fuel from said housing;

an intensifier that moves between a return position and a power position, wherein said intensifier delivers the fuel from the pressure chamber to the nozzle when the intensifier moves from the return position to the power position, said intensifier being adjacent to said pressure chamber, said first intensifier chamber and said second intensifier chamber, said second intensifier chamber being in fluid communication with said return working port;

a needle valve that controls the discharge of the fuel from said housing by said nozzle, said nozzle discharging the fuel from said housing as the intensifier moves from the return position to the power position;

a valve housing;

a spool that is located within said valve housing and moves between a first position and a second position, said spool having a groove that provides fluid communication between said return working passage and said intensifier passage when said spool is in said first position, wherein said intensifier moves to the return position, and said intensifier chamber is in fluid communication with said supply working port when said spool is in said second position, wherein said intensifier chamber is pressurized and said intensifier moves to the power position;

a first solenoid that can be energized to move said spool from said second position to said first position; and, a second solenoid that can be energized to move said spool from said first position to said second position.

11. The fuel injector as recited in claim 10, wherein said valve housing has a pair of bearing surfaces, said spool being cylindrical in shape with a pair opposite ends that engage said bearing surface and an outer longitudinal wall between said ends which contain the groove and the passages.

12. The fuel injector as recited in claim 10, wherein said spool moves within a valve chamber of said valve housing, said spool having a pair of openings that provide fluid communication between said inner chamber and said valve chamber.

13. The fuel injector as recited in claim 10, wherein said housing has a passage that provides fluid communication between said fuel port and a spring chamber which houses a spring that urges said needle valve toward said nozzle.

14. The fuel injector as recited in claim 10, wherein said housing has a passage that provides fluid communication between said supply working passage and a nozzle return chamber.

15. The fuel injector as recited in claim 10, wherein said valve housing and said spool are constructed from a magnetic material with enough residual magnetism to maintain said spool position when said solenoids are de-energized and allows said spool end to be separated from said valve housing when said solenoid is energized.

16. The fuel injector as recited in claim 10, wherein the working fluid is also the fuel.

17. The fuel injector as recited in claim 10, wherein the working fluid is also the fuel.

18. The fuel injector as recited in claim 10, wherein said housing has a passage that provides fluid communication between said supply working passage and a nozzle return chamber to supply said working fluid to urge said needle valve toward said nozzle.

19. The fuel injector as recited in claim 10, wherein delivery of the fuel from the pressure chamber to the nozzle lifts said needle valve away from said nozzle as the intensifier moves from the return position to the power position.

20. A hydraulically-actuated fuel injector assembly comprising:

a fuel pumping assembly comprising:

a pump housing;

a fuel inlet formed in said pump housing for receiving a fuel;

a pressure chamber formed in said pump housing, said pressure chamber in fluid communication with said fuel port;

a nozzle formed in said pump housing, said nozzle in fluid communication with said pressure chamber, said nozzle to discharge the fuel from said pump housing;

a reciprocable piston disposed in said pump housing, said reciprocable piston periodically pumping the fuel from the fuel inlet through said nozzle so that the fuel is discharged through said nozzle as it is pressurized by said reciprocable piston; and an electro-hydraulic control valve assembly associated with said fuel pumping assembly, said control valve assembly comprising:

a valve housing;

a first conduit formed in said valve housing, said first conduit being fluidly coupled to said reciprocable piston disposed in said fuel pumping assembly;

a second conduit formed in said valve housing, said second conduit being fluidly coupled to a source of pressurized hydraulic fluid;

a third conduit formed in said valve housing;

an unbiased valve element disposed in said valve housing, said valve element having a first end, a second end, and a flow passageway disposed between said first and second ends, said valve element being movable between a first position in which said first conduit is fluidly coupled to said second conduit via said flow passageway to supply pressurized hydraulic fluid to said fuel pumping assembly and in which said first conduit is fluidly isolated from said third conduit and a second position in which said first conduit is fluidly coupled to said third conduit to allow hydraulic fluid to be drained from said fuel pumping assembly and in which said first conduit is fluidly isolated from said second conduit;

a first electromagnetic device associated with said first end of said valve element, said first device causing said valve element to occupy one of said first and second positions when said first device is electrically energized; and a second electromagnetic device associated with said second end of said valve element, said second device causing said valve element to occupy the other of said first and second positions when said second device is electrically energized.

21. A fuel injector assembly as defined in claim 20 wherein said valve element has a substantially hollow interior portion.

22. A fuel injector assembly as defined in claim 20 wherein said valve element has an internal bore extending from said first end of said valve element to said second end of said valve element.

23. A fuel injector assembly as defined in claim 20 wherein said first end of said valve element has a first diameter, said second end of said valve element has a second diameter substantially the same as said first diameter, and wherein said valve element has a middle portion having a third diameter less than said first diameter and said second diameter.

24. A fuel injector assembly as defined in claim 20 wherein said second conduit has an opening that is partially blocked by said valve element when said valve element is in said first position and wherein said third conduit has an opening that is partially blocked by said valve element when said valve element is in said second position.

25. A fuel injector assembly as defined in claim 20 wherein said valve element remains latched in said first position via residual magnetism after said first device is deenergized and wherein said valve element remains latched in said second position via residual magnetism after said second device is deenergized.

26. A fuel injector assembly as defined in claim 20 Wherein said reciprocable piston has a substantially hollow interior portion.

27. The fuel injector as recited in claim 20, further comprising a needle valve that controls the discharge of the fuel from said pump housing by said nozzle, the reciprocable piston lifting said needle valve away from said nozzle and discharging the fuel from said pump housing by pumping the fuel from the pressure chamber to said nozzle.

28. A fuel injector assembly comprising:

a fuel pumping assembly comprising:

a pump housing;

a fuel inlet formed in said pump housing for receiving a fuel;

a pressure chamber formed in said pump housing, said pressure chamber in fluid communication with said fuel port;

a nozzle formed in said pump housing, said nozzle in fluid communication with said pressure chamber, said nozzle to discharge the fuel from said pump housing;

a reciprocable piston disposed in said pump housing, said reciprocable piston periodically pumping the fuel from the fuel inlet through said nozzle so that the fuel is discharged through said nozzle as it is pressurized by said reciprocable piston; and a control valve associated with said fuel pumping assembly, said control valve comprising:

a valve housing;

a first conduit formed in said valve housing, said first conduit being fluidly coupled to said reciprocable piston disposed in said fuel pumping assembly;

a second conduit formed in said valve housing, said second conduit being fluidly coupled to a source of pressurized hydraulic fluid;

a third conduit formed in said valve housing;

a valve element disposed in said valve housing, said valve element having a first end, a second end, and a flow passageway disposed between said first and second ends, said valve element being movable between a first position in which said first conduit is fluidly coupled to said second conduit via said flow passageway to supply pressurized hydraulic fluid to said fuel pumping means and in which said first conduit is fluidly isolated from said third conduit and a second position in which said first conduit is fluidly coupled to said third conduit to allow hydraulic fluid to be drained from said fuel pumping means and in which said first conduit is fluidly isolated from said second conduit;

a first electromagnetic device associated with said first end of said valve element, said first device causing said valve element to occupy one of said first and second positions when said first device is energized; and a second electromagnetic device associated with said second end of said valve element, said second device causing said valve element to occupy the other of said first and second positions when said second device is energized.

29. A fuel injector assembly as defined in claim 28 Wherein said valve element has a substantially hollow interior portion.

30. A fuel injector assembly as defined in claim 28 wherein said valve element has an internal bore extending from said first end of said valve element to said second end of said valve element.

31. A fuel injector assembly as defined in claim 28 wherein said first end of said valve element has a first diameter, said second end of said valve element has a second diameter substantially the same as said first diameter, and wherein said valve element has a middle portion having a third diameter less than said first diameter and said second diameter.

32. A fuel injector assembly as defined in claim 28 wherein said second conduit has an opening that is partially blocked by said valve element when said valve element is in said first position and wherein said third conduit has an opening that is partially blocked by said valve element when said valve element is in said second position.

33. A fuel injector assembly as defined in claim 28 wherein said valve element remains latched in said first position via residual magnetism after said first device is deenergized and wherein said valve element remains latched in said second position via residual magnetism after said second device is deenergized.

34. A fuel injector assembly as defined in claim 28 wherein said reciprocable piston has a substantially hollow interior portion.

35. The fuel injector as recited in claim 28, further comprising a needle valve that controls the discharge of the fuel from said pump housing by said nozzle, the reciprocable piston lifting said needle valve away from said nozzle and discharging the fuel from said pump housing by pumping the fuel from the pressure chamber to said nozzle.

36. A fuel injector assembly comprising:

a fuel discharging assembly comprising:

a discharge housing;

a fuel inlet formed in said discharge housing for receiving a fuel;

a pressure chamber formed in said discharge housing, said pressure chamber in fluid communication with said fuel port;

a nozzle formed in said discharge housing, said nozzle in fluid communication with said pressure chamber, said nozzle to discharge the fuel from said discharge housing;

a reciprocable piston disposed in said discharge housing, said reciprocable piston periodically discharging the fuel from the fuel inlet through said nozzle so that the fuel is discharged through said nozzle as it is pressurized by said reciprocable piston; and and a control valve associated with the fuel discharging means, the control valve comprising;

a valve housing;

a passageway in the valve housing, the passageway being fluidly coupled to said reciprocable piston disposed in the fuel discharging assembly;

a supply passageway in the valve housing, the supply passageway being fluidly coupled to a source of pressurized hydraulic fluid;

a drain passageway formed in the valve housing;

a spool valve disposed in the valve housing, the spool valve having an outer groove for passage of hydraulic fluid, the spool being moveable between a supply position in which the passageway is fluidly coupled to the supply passageway by way of the groove to supply hydraulic fluid to the fuel discharging means and in which the passageway is isolated from the drain passageway, and a drain position in which the passageway is fluidly coupled to the drain passageway by way of the groove to allow hydraulic fluid to be drained from the fuel discharging means and in which said passageway is fluidly isolated from the supply passageway;

a first electromagnetic device associated with the spool valve, the first electromagnetic device causing the spool valve to occupy one of the supply and drain positions when the electromagnetic device is energized;

a second electromagnetic device associated with the spool valve, the second electromagnetic device causing the spool valve to occupy one of the supply and drain positions when the electromagnetic device is energized.

37. A fuel injector assembly as defined in claim 36 wherein said spool valve has an inner chamber.

38. A fuel injector assembly as defined in claim 36 wherein the spool valve has a first end, a second end, and an inner chamber having openings on the first and second ends forming a passage.

39. A fuel injector assembly as defined in claim 36 wherein the spool valve has a concave surface between the first and second ends of the spool.

40. A fuel injector assembly as defined in claim 36 wherein the spool valve is maintained in the supply position by magnetic hysteresis after the first electromagnetic device is deenergized and wherein the spool valve is maintained in the drain position by magnetic hysteresis after the second electromagnetic device is deenergized.

41. The fuel injector as recited in claim 36, further comprising a needle valve that controls the discharge of the fuel from said pump housing by said nozzle, the reciprocable piston lifting said needle valve away from said nozzle and discharging the fuel from said pump housing by pumping the fuel from the pressure chamber to said nozzle.

42. A hydraulically actuated fuel injector assembly comprising:

a fuel discharging assembly comprising:

a discharge housing;

a fuel inlet formed in said discharge housing for receiving a fuel;

a pressure chamber formed in said discharge housing, said pressure chamber in fluid communication with said fuel port;

a nozzle formed in said discharge housing, said nozzle in fluid communication with said pressure chamber, said nozzle to discharge the fuel from said discharge housing;

a reciprocable piston disposed in said discharge housing, said reciprocable piston periodically discharging the fuel from the fuel inlet through said nozzle so that the fuel is discharged through said nozzle as it is pressurized by said reciprocable piston; and and an electro-hydraulic energizable control valve associated with the fuel discharging assembly for controlling operation of the injector, the control valve comprising;

a valve housing;

a passageway in the valve housing, the passageway being fluidly coupled to said reciprocable piston disposed in the fuel discharging assembly;

a supply passageway in the valve housing, the supply passageway being fluidly coupled to a source of pressurized hydraulic fluid;

a drain passageway formed in the valve housing;

a spool valve disposed in the valve housing, the spool valve having an outer groove for passage of hydraulic fluid, the spool being moveable between a supply position in which the passageway is fluidly coupled to the supply passageway by way of the groove to supply hydraulic fluid to the fuel discharging means and in which the passageway is isolated from the drain passageway, and a drain position in which the passageway is fluidly coupled to the drain passageway by way of the groove to allow hydraulic fluid to be drained from the fuel discharging means and in which said passageway is fluidly isolated from the supply passageway;

a first electromagnetic device associated with the spool valve, the first electromagnetic device causing the spool valve to occupy one of the supply and drain positions when the electromagnetic device is energized;

a second electromagnetic device associated with the spool valve, the second electromagnetic device causing the spool valve to occupy one of the supply and drain positions when the electromagnetic device is energized.

43. A fuel injector assembly as defined in claim 42 wherein said spool valve has an inner chamber.

44. A fuel injector assembly as defined in claim 42 wherein the spool valve has a first end, a second end, and an inner chamber having openings on the first and second ends forming a passage.

45. A fuel injector assembly as defined in claim 42 wherein the spool valve has a concave surface between the first and second ends of the spool.

46. A fuel injector assembly as defined in claim 42 wherein the spool valve is maintained in the supply position by magnetic hysteresis after the first electromagnetic device is deenergized and wherein the spool valve is maintained in the drain position by magnetic hysteresis after the second electromagnetic device is deenergized.

47. The fuel injector as recited in claim 42, further comprising a needle valve that controls the discharge of the fuel from said pump housing by said nozzle, the reciprocable piston lifting said needle valve away from said nozzle and discharging the fuel from said pump housing by pumping the fuel from the pressure chamber to said nozzle.

* * * * *

UNITED STATES PATENT AND TRADEMARK OFFICE

CERTIFICATE OF CORRECTION

PATENT NO. : 6,257,499 B1
DATED : July 10, 2001
INVENTOR(S) : Oded E. Sturman

It is certified that error appears in the above-identified patent and that said Letters Patent is hereby corrected as shown below:

Title page,
Item [56], References Cited, FOREIGN PATENT DOUCMENTS, please insert -- 981664 12/1982 (RU) --.
Delete "198 23 337 A1 1/1996 (DE)."
Delete "0 0149 598 A2" and insert -- 0 149 598 A2 --.
Delete "0 184 040 A2" and insert -- 0 184 940 A2 --.
Delete "0 4235 236 A1" and insert -- 0 425 236 A1 --.
OTHER PUBLICATIONS, in the entry beginning "SAE Technical Paper Series 930271" delete "Manufacturin" and insert -- Manufacturing --.
U.S. PATENT DOCUMENTS, delete "4,114,658" and insert -- 4,114,648 --.
Delete "Molrikawa" and insert -- Morikawa --.

Column 7,
Line 27, delete "opening" and insert -- openings --.
Line 38, delete "Wherein" and insert -- wherein --.

Column 10,
Line 14, delete "Wherein" and insert -- wherein --.

Column 11,
Line 7, delete "Wherein" and insert -- wherein --.

Signed and Sealed this

Thirteenth Day of May, 2003

JAMES E. ROGAN
*Director of the United States Patent and Trademark Office*